US005960855A

United States Patent [19]

Assefpour-Dezfully et al.

[11] Patent Number: 5,960,855

[45] Date of Patent: Oct. 5, 1999

[54] APPARATUS FOR CASTING STEEL STRIP

[75] Inventors: Massoud Assefpour-Dezfully, Mt Keira; Kenneth Michael Browne, Wheelers Hill, both of Australia

[73] Assignees: Ishikawajima-Harima Heavy Industries Company Limited, Tokyo, Japan; BHP Steel (JLA) Pty Ltd, Melbourne, Australia

[21] Appl. No.: 09/035,102

[22] Filed: Mar. 5, 1998

Related U.S. Application Data

[62] Division of application No. 08/598,994, Feb. 9, 1996, Pat. No. 5,762,126.

[30] Foreign Application Priority Data

Feb. 10, 1995 [AU] Australia ..... PN1014

[51] Int. Cl.[6] ..... B22D 11/06; B22D 11/16

[52] U.S. Cl. ..... 164/417; 164/428

[58] Field of Search ..... 164/417, 415, 164/428

[56] References Cited

U.S. PATENT DOCUMENTS 5,584,337 12/1996 Nakashima et al. ..... 164/477

FOREIGN PATENT DOCUMENTS

| | | | |
|---|---|---|---|
| 59-199152 | 11/1984 | Japan | 164/428 |
| 62-9752 | 1/1987 | Japan | 164/475 |
| 62-9753 | 1/1987 | Japan | 164/417 |
| 62-77151 | 4/1987 | Japan | 164/428 |
| 63-30158 | 2/1988 | Japan | 164/475 |
| 3-86359 | 4/1991 | Japan | 164/415 |
| 3-275248 | 12/1991 | Japan | 164/475 |
| 4-4954 | 1/1992 | Japan | 164/480 |
| 4-89159 | 3/1992 | Japan | 164/480 |

*Primary Examiner*—J. Reed Batten, Jr.
*Attorney, Agent, or Firm*—Nikaido Marmelstein Murray & Oram LLP

[57] ABSTRACT

The apparatus includes a pair of cooled, rotating casting rolls forming a nip between them. Molten metal is delivered into the nip between the casting rolls to form a casting pool of molten metal supported on the rolls. The cast strip produced is delivered downwardly from the nip and guided through a transit path which takes it away from the nip. An enclosure confirms the strip throughout the transit path and includes an enclosure wall including a movable section disposed beneath the casting rolls and formed to serve as a movable receptacle for scrap produced at any stage of the casting process, which enclosure is sealed to control ingress of oxygen containing atmosphere during operation of the apparatus, thereby controlling the formation of scale on the strip during operation of the apparatus.

9 Claims, 6 Drawing Sheets

APPARATUS FOR CASTING STEEL STRIP

This application is a divisional application of U.S. Ser. No. 08/598,994, filed Feb. 9, 1996, now U.S. Pat. No. 5,762,126.

This invention relates to continuous casting of steel strip in a strip caster, particularly a twin roll caster.

In a twin roll caster molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel from which it flows through a metal delivery nozzle located above the nip so as to direct it into the nip between the rolls, so forming a casting pool of molten metal supported on the casting surfaces of the rolls immediately above the nip and extending along the length of the nip. This casting pool is usually confined between side plates or dams held in sliding engagement with end surfaces of the rolls so as to dam the two ends of the casting pool against outflow, although alternative means such as electromagnetic barriers have also been proposed.

When casting steel strip in a twin roll caster, the strip leaves the nip at very high temperatures, of the order of 1400° C., and it suffers very rapid scaling due to oxidation at such high temperatures. Such scaling results in a significant loss of steel product. For example, 3% of a 1.55 mm thick strip (typical scale thickness 35 microns) can be lost from some oxidation as the strip cools. Moreover, it results in the need to descale the strip prior to further processing to avoid surface quality problems, such as rolled-in scale, and this causes significant extra complexity and cost. For example, the hot strip material may be passed directly to a rolling mill in line with the strip caster and thence to a run out table on which it is cooled to coiling temperature before it is coiled. However scaling of the hot strip material emerging from the strip caster progresses so rapidly that it becomes necessary to install descaling equipment to descale the material immediately before it enters the in line rolling mill. Even in cases when the strip is cooled to coiling temperature without hot rolling, it will generally be necessary to descale the strip either before it is coiled or in a later processing step.

Japanese Patent 9753 of 1987 describes a proposal for dealing with the problem of rapid scaling of steel strip produced in a twin roll caster in which the steel strip is passed through a furnace containing a non-oxidising atmosphere produced by the discharge of exhaust gases from fuel burners of the furnace. The burners are operated so as to adjust the temperature of the strip and to maintain a non-oxidising atmosphere through which the strip passes to an in line rolling mill. This proposal requires complex control equipment and considerable energy input in order to maintain the necessary temperature controls and the generation of a non-oxidising atmosphere.

Japanese Patent Publication No 335706 of 1994 describes another proposal for dealing with the problem of rapid scaling of steel strip produced by a twin roll caster in which the steel strip is passed through a cooling atmosphere having a controlled composition with an oxygen content of no more than 5%. The exact composition of the cooling atmosphere is not explained but experiments are described in which cast strip is cooled in various atmospheres of controlled oxygen content. This publication accordingly proposes supply of a cooling gas of controlled composition into a strip cooling chamber.

The present invention provides a relatively cheap and energy efficient way of limiting exposure of the high temperature strip to oxygen which does not require a supply of gas of controlled composition. The strip is caused to pass through an enclosed space from which it extracts oxygen by the formation of scale and which is sealed so as to control the ingress of oxygen containing atmosphere whereby to control the extent of scale formation. We have determined that it is possible to rapidly reach a steady state condition in which scale formation is brought to very low levels without the need to deliver a non-oxidising or reducing gas into the enclosure, although it is within the scope of the invention to initially purge the enclosure with a non-oxidising gas on initiation of a casting process.

The invention is particularly, but not exclusively, applicable to processes in which hot steel strip from a strip caster is passed to a rolling mill for hot rolling in line with the strip caster. It has been determined that a thin film of scale on the strip is necessary to prevent welding and sticking during hot rolling and the controlled scaling produced by the present invention enables the direct formation of such a thin film while avoiding the problems and penalties caused by excessive scaling.

According to the invention there is provided a method of continuously casting steel strip comprising:

supporting a casting pool of molten steel on one or more chilled casting surfaces;

moving the chilled casting surface or surfaces to produce a solidified strip moving away from the casting pool; and guiding the solidified strip along a transit path which takes it away from the casting pool;

wherein the strip is confined throughout said transit path within an enclosure from which oxygen is extracted by oxidation of the strip passing through it and which is sealed to control ingress of oxygen containing atmosphere whereby to control the formation of scale on the strip as it passes through said transit path.

The strip may be passed to a coiler after leaving said transit path. It may be subjected to accelerated cooling while traversing said transit path or after leaving the transit path but prior to coiling. In either case, it is preferred that the ingress of oxygen containing atmosphere into the sealed enclosure be controlled such that the scale on the strip at the coiler is no more than 20 microns thick, but preferably no more than 10 microns.

In a preferred method according to the invention, the solidified steel strip is delivered through said transit path to a hot rolling mill in which it is hot rolled in line with the strip caster. In this case, the ingress of oxygen containing atmosphere into the sealed enclosure is preferably controlled so as to limit the formation of scale on the strip to the extent that the scale on the strip entering the rolling mill is no more than 10 microns thick.

Preferably, the thickness of scale on the strip entering the rolling mill is in the range 0.5 to 8 microns. More particularly, it is preferred that the thickness of scale on the strip at this location be in the range 1 to 5 microns.

Preferably, the enclosure encloses said strip from its formation at the casting pool. It may, for example, completely enclose the casting pool.

The strip may exit the enclosure before entering the rolling mill and in this case the enclosure may comprise a pair of pinch rolls between which the strip passes to exit the enclosure. Alternatively, strip may remain within the enclosure at its entry into the rolling mill. This may be achieved by enclosing the rolling mill within the enclosure or sealing the enclosure against rolls of the rolling mill.

According to another aspect of the invention there is provided a method of continuously casting steel strip comprising:

supporting a casting pool of molten steel on a pair of chilled casting rolls forming a nip between them;

rotating the casting rolls in mutually opposite directions to produce a solidified strip passing downwardly from the nip; and guiding the solidified strip along a transit path which takes it away from the nip;

wherein the strip is confined throughout said transit path within an enclosure from which oxygen is extracted by oxidation of the strip passing through it and which is sealed to control ingress of oxygen containing atmosphere whereby to control the formation of scale on the strip as it passes through said transit path.

Preferably, the enclosure encloses said strip from its formation at the nip between the casting rolls.

The invention further provides apparatus for casting steel strip comprising:

a pair of generally horizontal casting rolls forming a nip between them;

metal delivery means to deliver molten steel into the nip between the casting rolls to form a casting pool of molten steel supported on the rolls;

means to chill the casting rolls;

means to rotate the casting rolls in mutually opposite directions whereby to produce a cast strip delivered downwardly from the nip;

strip guide means to guide the strip delivered downwardly from the nip through a transit path which takes it away from the nip; and an enclosure to confine the strip throughout said transit path, which enclosure is sealed to control ingress of oxygen containing atmosphere during operation of the apparatus, thereby controlling the formation of scale on the strip during operation of the apparatus.

The enclosure may comprise an enclosure wall including a movable section disposed beneath the casting rolls and formed to serve as a movable receptacle for scrap produced at any stage of the casting process.

The movable section may be in the form of an open topped box mounted on wheels for movement between an operative position in which it forms part of the enclosure and a scrap discharge position.

Sealing means may be provided to form a seal between said movable section and the remainder of the wall when the box is in its operative position.

In order that the invention may be more fully explained one particular embodiment will be described in detail with reference to the accompanying drawings in which.

Figure 1:
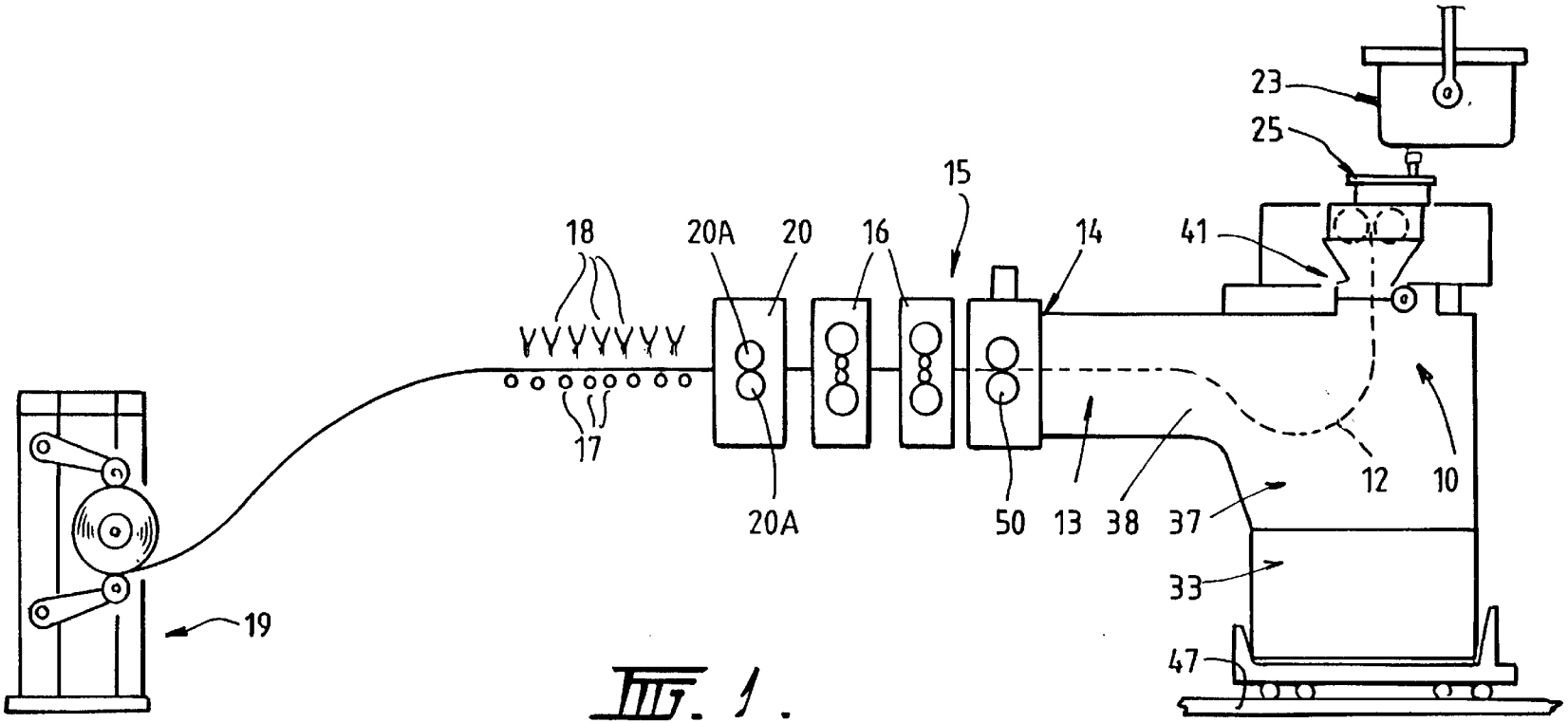
FIG. 1 is a vertical cross-section through a steel strip casting and rolling installation constructed and operated in accordance with the present invention.
Figure 2:
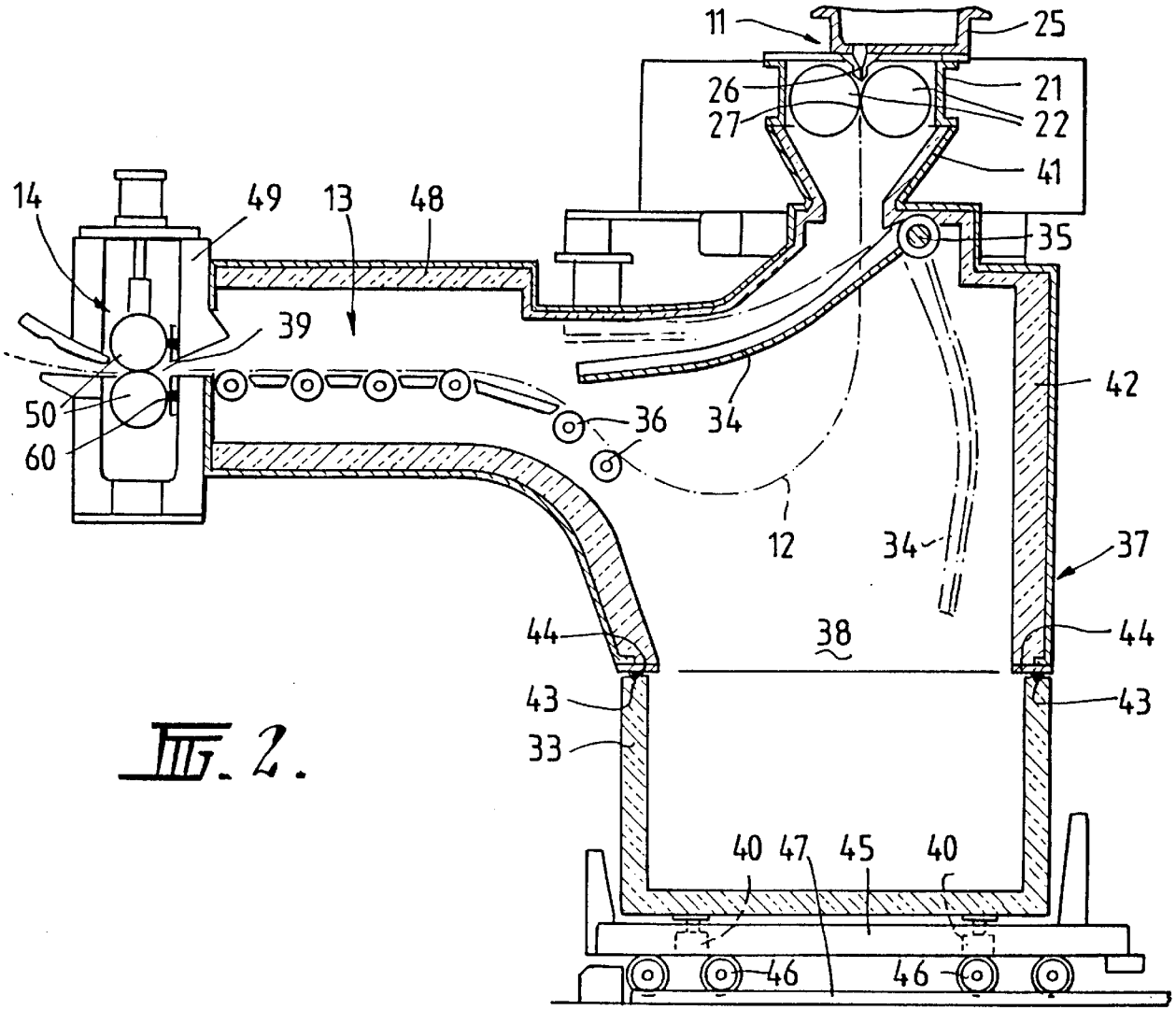
FIG. 2 illustrates essential components of a twin roll caster incorporated in the installation.
Figure 3:
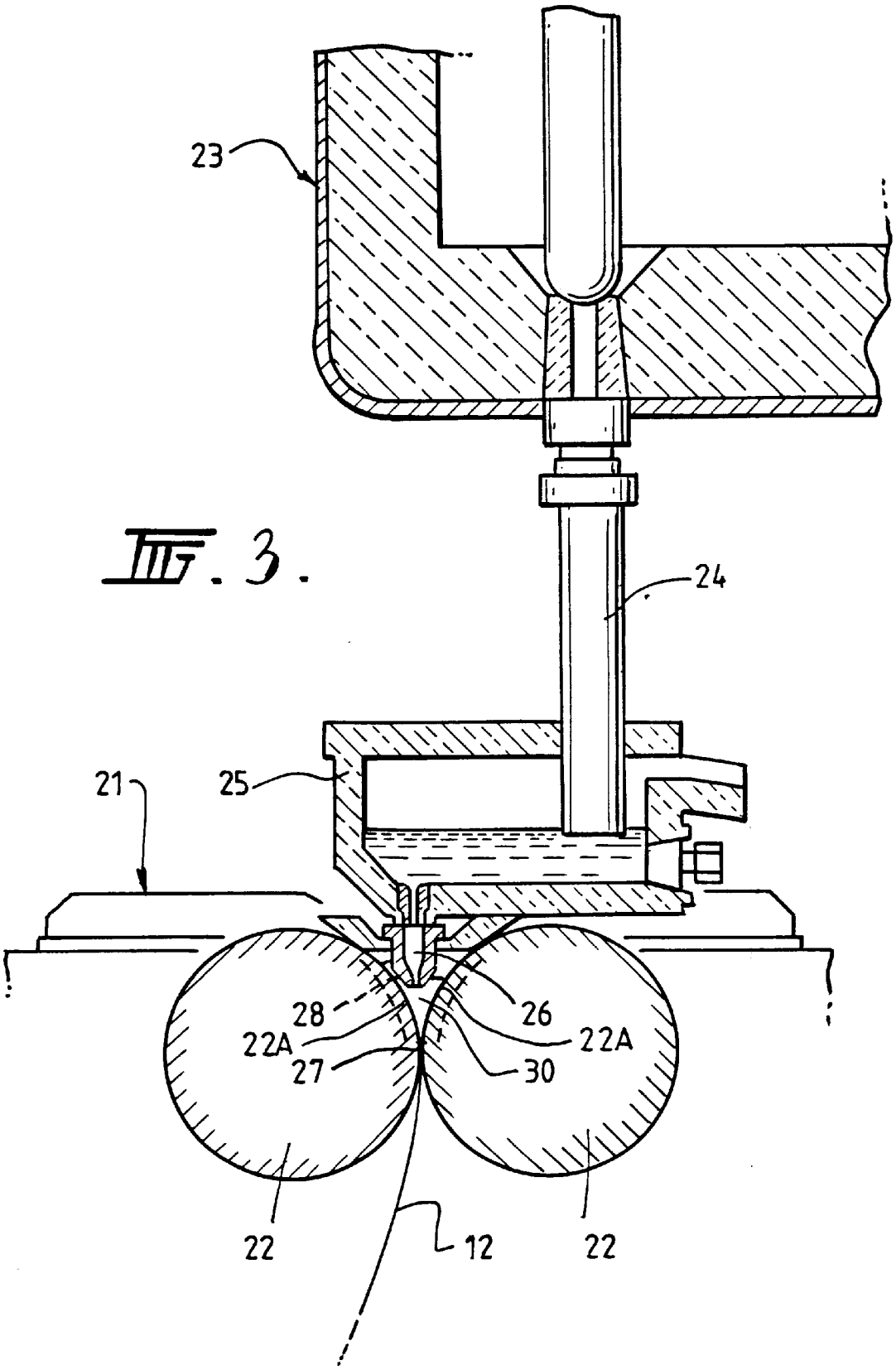
FIG. 3 is a plan view of part of the twin roll caster.
Figure 4:
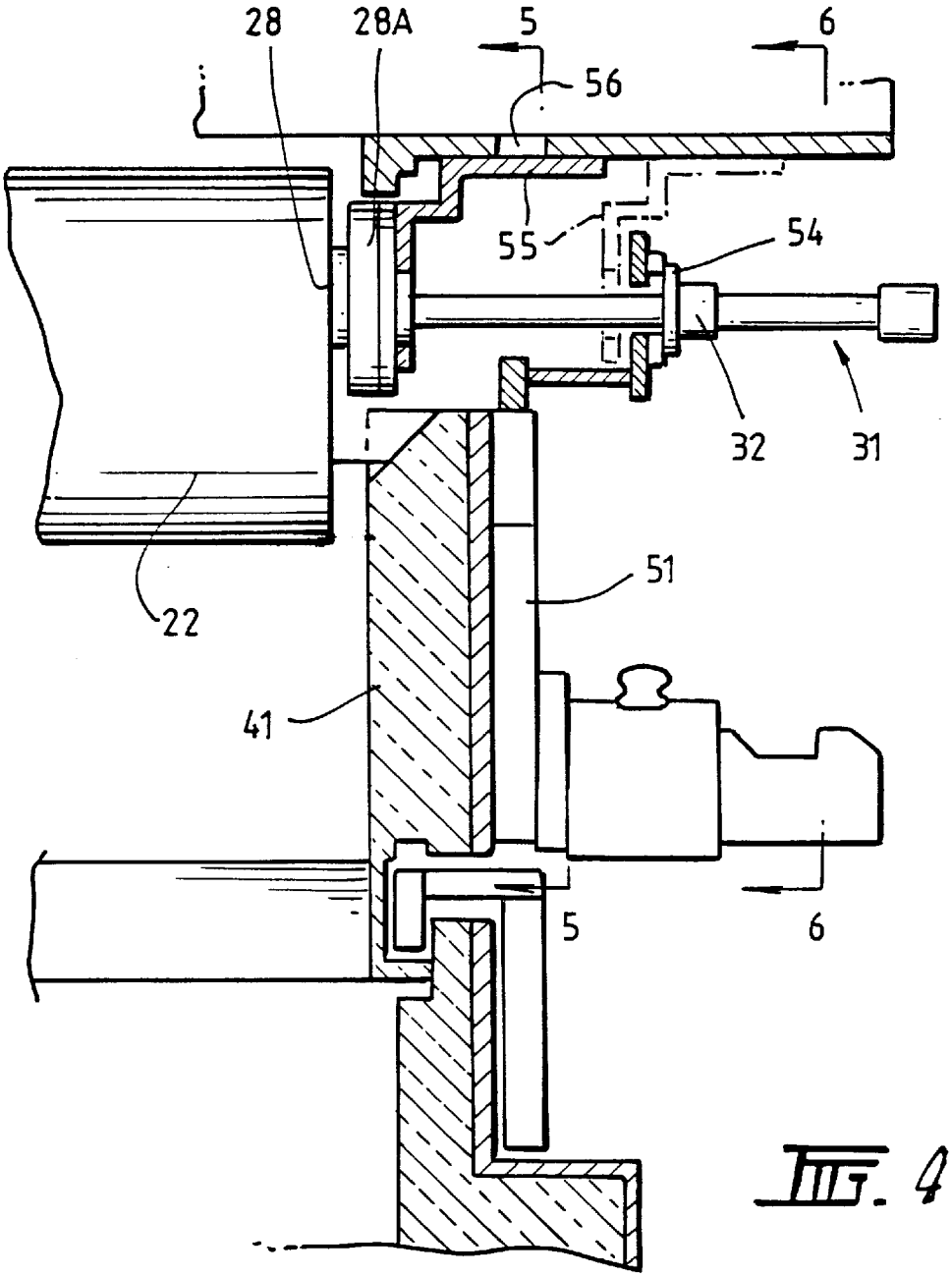
FIG. 4 is an enlarged vertical cross-section through an end part of the twin roll caster.
Figure 5:
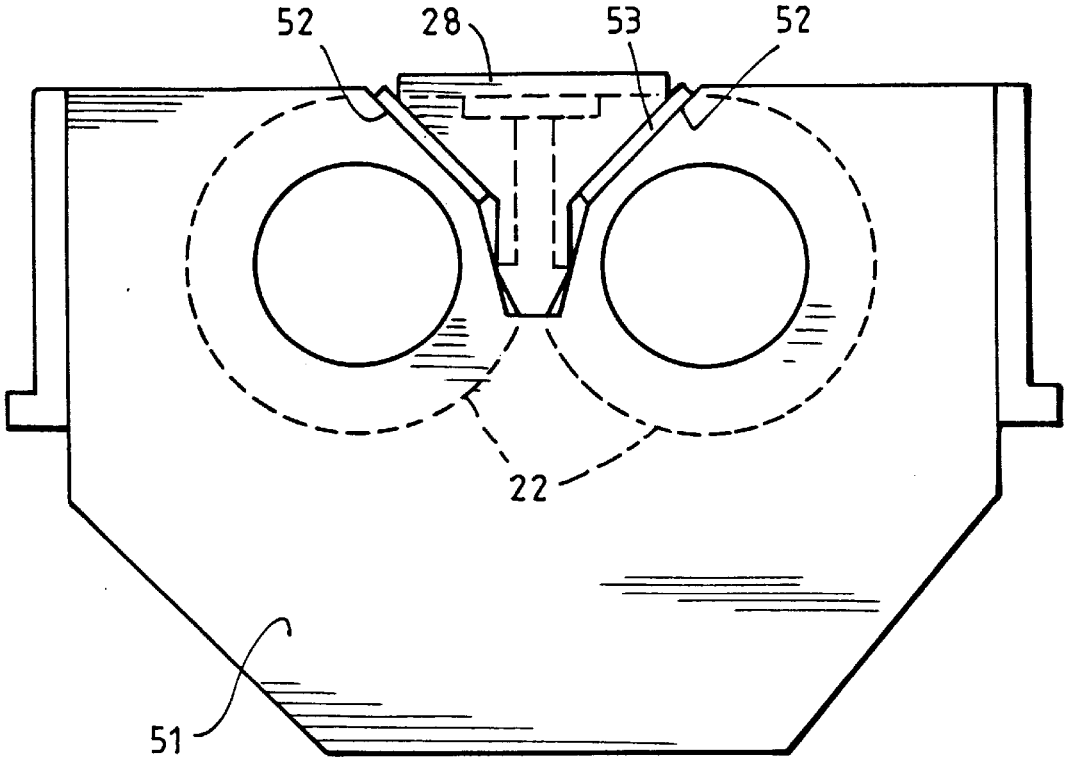
FIG. 5 is a cross-section on the line 5–5 in FIG. 4.
Figure 6:
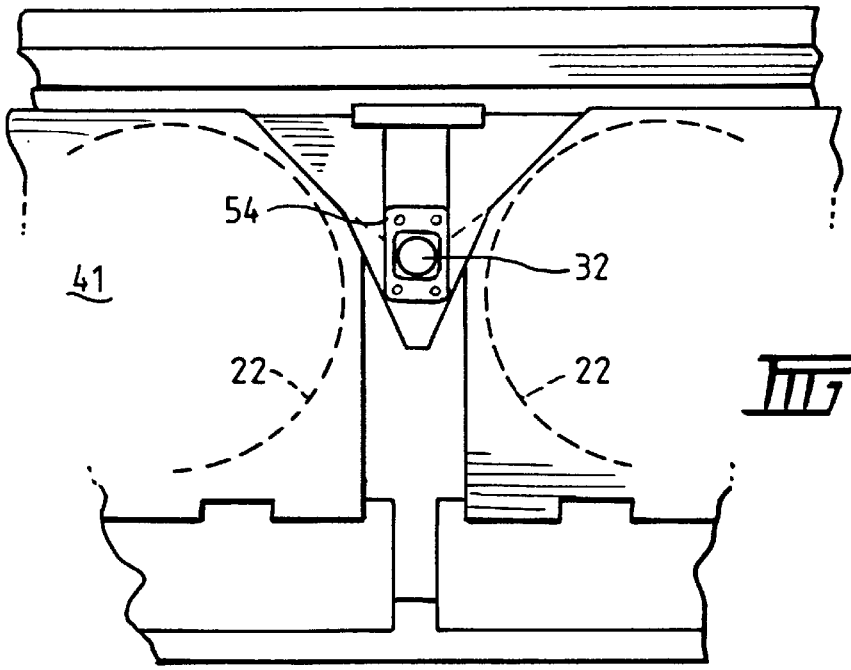
FIG. 6 is a view on the line 6—6 in FIG. 4.

The illustrated casting and rolling installation comprises a twin roll caster denoted generally as 11 which produces a cast steel strip 12 which passes in a transit path 10 across a guide table 13 to a pinch roll stand 14. Immediately after exiting the pinch roll stand 14, the strip passes into a hot rolling mill 15 comprising roll stands 16 in which it is hot rolled to reduce its thickness. The thus rolled strip exits the rolling mill through a pinch roll stand 20 comprising a pair of pinch rolls 20A and passes to a run out table 17 on which it may be force cooled by water jets 18 and thence to a coiler 19.

Twin roll caster 11 comprises a main machine frame 21 which supports a pair of parallel casting rolls 22 having casting surfaces 22A. Molten metal is supplied during a casting operation from a ladle 23 through a refractory ladle outlet shroud 24 to a tundish 25 and thence through a metal delivery nozzle 26 into the nip 27 between the casting rolls 22. Hot metal thus delivered to the nip 27 forms a pool 30 above the nip and this pool is confined at the ends of the rolls by a pair of side closure dams or plates 28 which are applied to stepped ends of the rolls by a pair of thrusters 31 comprising hydraulic cylinder units 32 connected to side plate holders 28A. The upper surface of pool 30 (generally referred to as the "meniscus" level) may rise above the lower end of the delivery nozzle so that the lower end of the delivery nozzle is immersed within this pool.

Casting rolls 22 are water cooled so that shells solidify on the moving roller surfaces and are brought together at the nip 27 between them to produce the solidified strip 12 which is delivered downwardly from the nip between the rolls.

At the start of a casting operation a short length of imperfect strip is produced as the casting conditions stabilise. After continuous casting is established, the casting rolls are moved apart slightly and then brought together again to cause this leading end of the strip to break away in the manner described in Australian Patent Application 27036/92 so as to form a clean head end of the following cast strip. The imperfect material drops into a scrap box 33 located beneath caster 11 and at this time a swinging apron 34 which normally hangs downwardly from a pivot 35 to one side of the easter outlet is swung across the caster outlet to guide the clean end of the cast strip onto the guide table 13 which feeds it to the pinch roll stand 14. Apron 34 is then retracted back to its hanging position to allow the strip 12 to hang in a loop beneath the caster before it passes to the guide table 13 where it engages a succession of guide rollers 36.

The twin roll caster may be of the kind which is illustrated and described in some detail in granted Australian Patents 631728 and 637548 and U.S. Pats. 5,184,668 and 5,277,243 and reference may be made to those patents for appropriate constructional details which form no part of the present invention.

In accordance with the present invention the installation is manufactured and assembled to form a single very large scale enclosure denoted generally as 37 defining a sealed space 38 within which the steel strip 12 is confined throughout a transit path from the nip between the casting rolls to the entry nip 39 of the pinch roll stand 14.

Enclosure 37 is formed by a number of separate wall sections which fit together at various seal connections to form a continuous enclosure wall. These comprise a wall section 41 which is formed at the twin roll caster to enclose the casting rolls and a wall section 42 which extends downwardly beneath wall section 41 to engage the upper edges of scrap box 33 when the scrap box is in its operative position so that the scrap box becomes part of the enclosure. The scrap box and enclosure wall section 42 may be connected by a seal 43 formed by a ceramic fibre rope fitted into a groove in the upper edge of the scrap box and engaging flat sealing gasket 44 fitted to the lower end of wall section 42. Scrap box 33 may be mounted on a carriage 45 fitted with wheels 46 which run on rails 47 whereby the scrap box can be moved after a casting operation to a scrap discharge position. Cylinder units 40 are operable to lift the scrap box from carriage 45 when it is in the operative position so that it is pushed upwardly against the enclosure wall section 42 and compresses the seal 43. After a casting operation the cylinder units 40 are released to lower the scrap box onto carriage 45 to enable it to be moved to scrap discharge position.

Enclosure 37 further comprises a wall section 48 disposed about the guide table 13 and connected to the frame 49 of pinch roll stand 14 which includes a pair of pinch rolls 50 against which the enclosure is sealed by sliding seals 60. Accordingly, the strip exits the enclosure 38 by passing between the pair of pinch rolls 50 and it passes immediately into the hot rolling mill 15. The spacing between pinch rolls 50 and the entry to the rolling mill should be as small as possible and generally of the order of 1 metre or less so as to control the formation of scale prior to entry into the rolling mill.

Most of the enclosure wall sections may be lined with fire brick and the scrap box 33 may be lined either with fire brick or with a castable refractory lining.

The enclosure wall section 41 which surrounds the casting rolls is formed with side plates 51 provided with notches 52 shaped to snugly receive the side dam plate holders 28A when the side dam plates 28 are pressed against the ends of the rolls by the cylinder units 32. The interfaces between the side plate holders 28A and the enclosure side wall sections 51 are sealed by sliding seals 53 to maintain sealing of the enclosure. Seals 53 may be formed of ceramic fibre rope.

The cylinder units 32 extend outwardly through the enclosure wall section 41 and at these locations the enclosure is sealed by sealing plates 54 fitted to the cylinder units so as to engage with the enclosure wall section 41 when the cylinder units are actuated to press the side plates against the ends of the rolls. Thrusters 31 also move refractory slides 55 which are moved by the actuation of the cylinder units 32 to close slots 56 in the top of the enclosure through which the side plates are initially inserted into the enclosure and into the holders 28A for application to the rolls. The top of the enclosure is closed by the tundish, the side plate holders 28A and the slides 55 when the cylinder units are actuated to apply the side dam plates against the rolls. In this way the complete enclosure 37 is sealed prior to a casting operation to establish the sealed space 38, thereby limiting the supply of oxygen to the strip 12 as it passes from the casting rolls to the pinch roll stand 14. Initially the strip will take up all of the oxygen from the enclosure space 38 to form heavy scale on the strip. However, the sealing of space 38 controls the ingress of oxygen containing atmosphere below the amount of oxygen that could be taken up by the strip. Thus, after an initial start up period the oxygen content in the enclosure space 38 will remain depleted so limiting the availability of oxygen for oxidation of the strip. In this way, the formation of scale is controlled without the need to continuously feed a reducing or non-oxidising gas into the enclosure space 38. In order to avoid the heavy scaling during the start-up period, the enclosure space can be purged immediately prior to the commencement of casting so as to reduce the initial oxygen level within the enclosure and so reduce the time for the oxygen level to be stabilised as a result of the interaction of oxygen from the scaled enclosure due to oxidation of the strip passing through it. The enclosure may conveniently be purged with nitrogen gas. It has been found that reduction of the initial oxygen content to levels of between 5% to 10% will limit the scaling of the strip at the exit from the enclosure to about 10 microns to 17 microns even during the initial start-up phase.

In a typical caster installation the temperature of the strip passing from the caster will be of the order of 1400° C. and the temperature of the strip presented to the mill will be about 1200° C. The strip may have a width in the range 0.9 m to 1.8 m and a thickness in the range 1.0 mm to 2.0 mm. The strip speed may be of the order of 1.0 m/s. It has been found that with strip produced under these conditions it is quite possible to control the leakage of air into the enclosure space 38 to such a degree as to limit the growth of scale on the strip to a thickness of less than 5 microns at the exit from the enclosure space 38, which equates to an average oxygen level of 2% within that enclosure space. The volume of the enclosure space 38 is not particularly critical since all of the oxygen will rapidly be taken up by the strip during the initial start up phase of a casting operation and the subsequent formation of scale is determined solely by the rate of leakage of atmosphere into the enclosure space through the seals. It is preferred to control this leakage rate so that the thickness of the scale at the mill entry is in the range 1 micron to 5 microns. Experimental work has shown that the strip needs some scale on its surface to prevent welding and sticking during hot rolling. Specifically, this work suggests that a minimum thickness of the order of 0.5 to 1 micron is necessary to ensure satisfactory rolling. An upper limit of about 8 microns and preferably 5 microns is desirable to avoid "rolled-in scale" defects in the strip surface after rolling and to ensure that scale thickness on the final product is no greater than on conventionally hot rolled strip.

Figure 7:
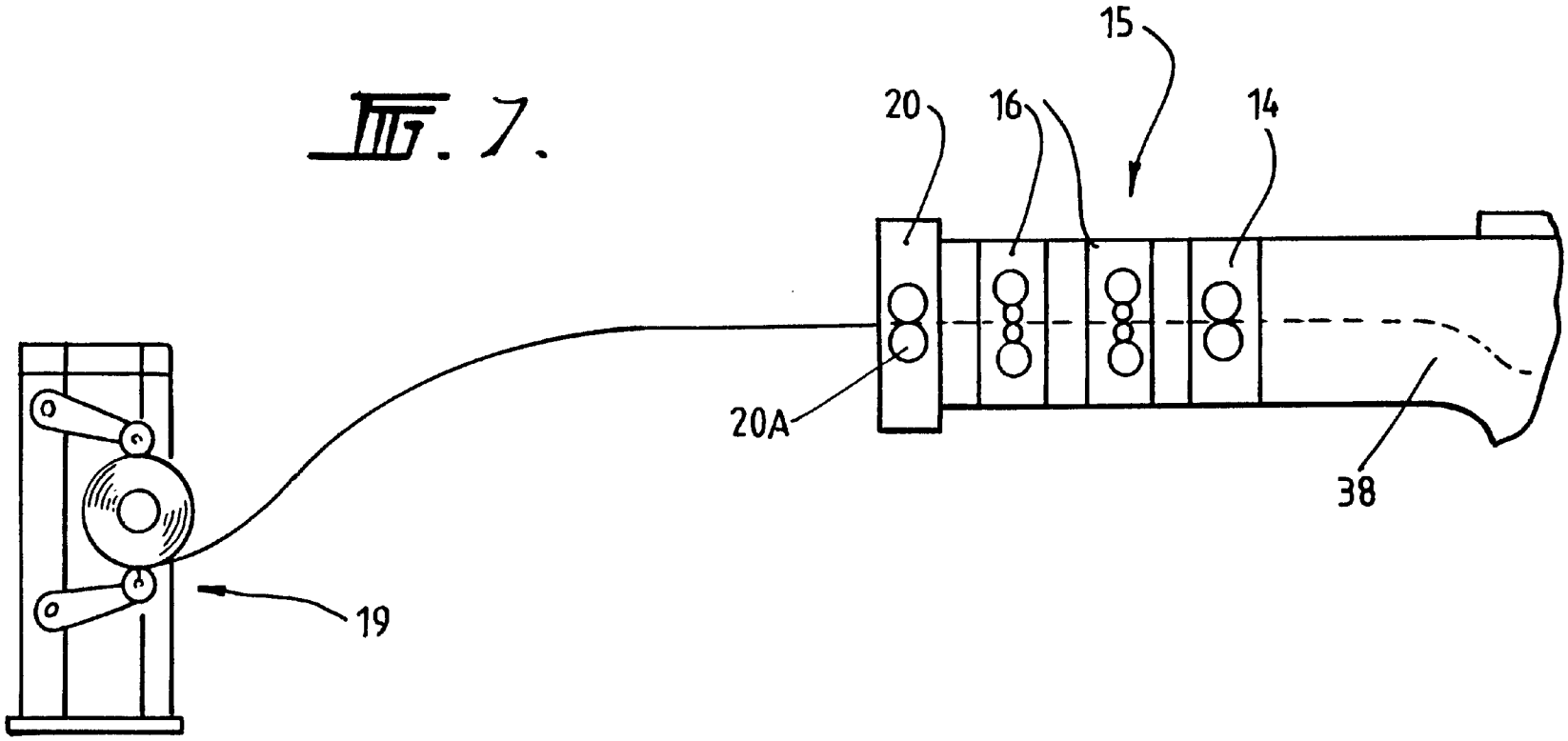
FIG. 7 is a diagrammatic view of part of a modified strip casting and rolling installation constructed and operated in accordance with the invention.

FIG. 7 illustrates a modification by which the enclosure 37 is extended to enclose the rolling mill 15 so that the strip is rolled before it leaves the enclosure space 38. In this case, the strip exits the enclosure through the last of the mill stands 16 the rolls of which serve also to seal the enclosure so that separate sealing pinch rolls are not required.

The illustrated forms of apparatus have been described by way of example only and may be modified considerably. For example, the invention is not limited in its application to processes in which the cast strip is hot rolled in line with the caster and it could be applied to the control of scale on strip which is simply reduced in temperature and coiled after casting. The strip may; for example, pass over a run out table after casting on which it is force cooled to a coiling temperature of the order of 600° C. In this case the oxidation retarding enclosure could enclose the run out table or the strip could exit the oxidation retarding enclosure prior to passing to the run out table. In cases where the strip is to be hot rolled within the enclosure, the enclosure could extend completely around the rolling mill or it could be sealed against rolls of the mill by sliding seals. In all cases it is desirable that the strip should be reduced to a temperature of less than about 1250° C. before exiting the enclosure in order to avoid subsequent rapid build up of scale.

We claim:

1. Apparatus for casting steel strip comprising:

a pair of generally horizontal casting rolls forming a nip between them;

metal delivery means to deliver molten steel into the nip between the casting rolls to form a casting pool of molten steel supported on the rolls;

means to chill the casting rolls;

means to rotate the casting rolls in mutually opposite directions, thereby producing a cast strip delivered downwardly from the nip;

strip guide means to guide the strip delivered downwardly from the nip through a transit path which takes it away from the nip; and an enclosure to confine the strip throughout said transit path comprising an enclosure wall including a movable section disposed beneath the casting rolls and formed to serve as a movable receptacle for scrap produced at any stage of the casting process, which enclosure is sealed to control ingress of oxygen containing atmosphere during operation of the apparatus, thereby controlling the formation of scale on the strip during operation of the apparatus.

2. Apparatus as claimed in claim 1, wherein sealing movable section is in the form of an open topped box mounted on wheels for movement between an operative position in which it forms part of the enclosure and a scrap discharge position.

3. Apparatus as claimed in claim 2, wherein sealing means is provided to form a seal between said movable section and the remainder of the wall when the box is in its operative position.

4. Apparatus as claimed in claim 1 and further comprising a hot rolling mill to receive the cast strip from said transit path and to roll that strip in line with the strip caster.

5. Apparatus as claimed in claim 4, wherein the rolling mill is outside said enclosure.

6. Apparatus as claimed in claim 4, wherein the rolling mill is within the enclosure.

7. Apparatus as claimed in claim 1, wherein the enclosure completely encloses the casting rolls.

8. Apparatus as claimed in claim 1, wherein the enclosure completely encloses the casting pool.

9. Apparatus as claimed in claim 1, wherein the enclosure encloses said strip from its formation at the nip between the casting rolls.

* * * * *